US005803425A

United States Patent [19]

McCoy, II

[11] Patent Number: 5,803,425

[45] Date of Patent: Sep. 8, 1998

[54] WALL HANGING DEVICES AND METHODS

[76] Inventor: Charles A. McCoy, II, 1635 Huntley Rd., Bellingham, Wash. 98226

[21] Appl. No.: 803,690

[22] Filed: Feb. 24, 1997

[51] Int. Cl.[6] ..... A47G 1/16

[52] U.S. Cl. ..... 248/493; 248/475.1; 248/909

[58] Field of Search ..... 248/466, 475.1, 248/489, 493, 495, 909

[56] References Cited

U.S. PATENT DOCUMENTS

| | | | |
|---|---|---|---|
| 458,711 | 9/1891 | Green . | |
| 822,048 | 5/1906 | Horinko | 248/493 |
| 1,025,964 | 5/1912 | Costuma | 248/493 |
| 1,908,200 | 5/1933 | Webster | 248/495 |
| 2,330,373 | 9/1943 | Moore | 248/489 |
| 2,334,700 | 11/1943 | Frey | 248/32 |
| 2,384,478 | 9/1945 | Lapeyre | 248/493 X |
| 2,454,813 | 11/1948 | Larson | 248/32 |
| 2,496,990 | 2/1950 | Downing | 248/493 |
| 3,063,669 | 11/1962 | Bell | 248/489 X |
| 3,982,719 | 9/1976 | Kilborne | 248/489 |
| 4,026,510 | 5/1977 | Holmes | 248/493 |
| 4,315,615 | 2/1982 | Scocozza | 248/489 |
| 4,610,419 | 9/1986 | Swanson | 248/547 |
| 5,267,719 | 12/1993 | Keller | 248/493 |
| 5,328,140 | 7/1994 | Wong | 248/493 |

FOREIGN PATENT DOCUMENTS

| | | | |
|---|---|---|---|
| 12500 | 10/1886 | United Kingdom | 248/489 |
| 27609 | 12/1908 | United Kingdom | 248/489 |
| 3169 | 2/1910 | United Kingdom | 248/493 |
| 24202 | 10/1910 | United Kingdom | 248/493 |
| 24849 | 10/1910 | United Kingdom | 248/495 |

*Primary Examiner*—James R. Brittain

*Attorney, Agent, or Firm*—Michael R. Schacht; Hughes & Schacht, P.S.

[57] ABSTRACT

A wall hanging device comprising a backing plate having a front surface and first and second rear surfaces formed on a slot defining structure. First and second slot portions are defined between the front surface and the first and second rear surfaces. The slot portions are spaced from each other to increase friction between a cord attached to a framed work and the device. The device has a reduced dimension portion located between the first and second rear surfaces that allows the device to be separated into first and second portions. The device can be used in a first mode in which the device is left whole and employed to hang a single framed work, a second mode in which the device is separated into two portions and employed to hang a single relatively large framed work, or a third mode in which the device is separated into two portions and employed to hang first and second relatively small framed works.

13 Claims, 5 Drawing Sheets

WALL HANGING DEVICES AND METHODS

TECHNICAL FIELD

The present invention relates to systems of hanging framed works such as pictures and documents on a wall or the like and, more particularly, to such systems that are flexible in use and which are adapted to maintain the framed work in a desired orientation on the wall over time.

BACKGROUND OF THE INVENTION

Works such as pictures and documents are often framed for display under a protective layer of glass. Normally, the frame comprises left side, right side, top, and bottom pieces joined together with mitered edges to form a rectangle, although other shapes may also be formed depending upon aesthetic considerations. The work is held by the frame between the glass layer and a backing layer. Often, matting is arranged between the edges of the work and the glass layer.

Such framed works are often hung on a wall or the like for display. The most common wall hanging system for framed works comprises a length of cord attached to the side pieces of the frame somewhat closer to the top piece than the bottom piece. A nail is driven into the wall, and the cord is placed over the nail such that the framed work is supported on the wall at a desired location.

A basic wall hanging system incorporating a nail and a cord is not particularly effective at maintaining the framed work in a desired orientation on the wall. In particular, when the framed work is in its desired orientation, the top and bottom edges thereof are normally level and/or aligned with horizontal wall features and other framed works hung on the wall.

But with the basic system employing a nail and a cord, wall vibrations, drafts, and other physical phenomena will, over time, often cause the framed work to move out of its desired orientation. Even slight deviations from the desired orientation are noticeable, and it is often difficult to get the framed work precisely back into its desired orientation. These deviations are especially noticeable and difficult to correct when a plurality of framed works of equal size are hung adjacent to one another.

The basic nail and cord system is also somewhat unreliable in that the nail does not provide a solid attachment to the wall. The entire load of the framed work is transmitted to the wall through the shaft of the nail. Loads transferred to the wall through the nail shaft tend to enlarge the hole in which the nail resides, thereby increasing the likelihood that the nail will fall out.

A number of wall hanging systems have been proposed and/or introduced to improve upon the basic nail and cord system described above. A primary purpose of these wall hanging systems is to improve the transfer of loads to the wall, but some of these systems are also designed to prevent movement of the cord that would allow the framed work to move out of its desired orientation.

Prior art wall hanging systems attempt to improve the transfer of loads to the wall in two basic ways. First, many of these systems include a hanging member that defines an engagement surface for engaging the wall surface below where the nail penetrates the wall. The load is applied to the hanging member. Part of the load is transferred to the wall through the engagement surface, and the load is not entirely transferred through the shaft of the nail.

Second, known hanging systems often employ additional nails or other fasteners to engage the wall. By providing additional fasteners, less of the load is borne by any one fastener. Both of these improvements reduce the likelihood that the shaft will enlarge the nail hole and allow the nail to fall out.

To prevent a framed work from shifting out of its desired orientation, the prior art teaches the use of a V-shaped channel for receiving the cord. The member defining the channel frictionally engages the cord to prevent relative movement between the channel defining member and the cord along the axis of the cord. This reduces the likelihood that the cord will move relative to the channel and cause the framed work to move out of its desired orientation.

OBJECTS OF THE INVENTION

From the foregoing, it should be apparent that one object of the present invention is to provide improved devices and methods for hanging framed works on a wall or the like.

Another object of the present invention is to provide wall hanging systems and methods having a favorable balance of the following characteristics:

a. allows a framed work to be hung in a desired orientation;

b. reduces movement of the framed work out of its desired orientation;

c. forms a reliable mechanical attachment between the framed work and the wall;

d. may be inexpensively manufactured;

e. does not require manufacture, shipment, sale, and storage of an excessive number of separate components;

f. allows a very wide framed object to be securely hung from a wall or the like; and g. can be used in one mode to hang two different framed works at different locations on the wall.

SUMMARY OF THE INVENTION

To achieve these and other objects, the present invention comprises a device having a backing plate from which first and second projections forwardly extend. The backing plate is adapted to be attached to a wall or the like with the projections facing away from the wall. Between the backing plate and the projections are formed first and second slot portions that define curved, V-shaped slots.

A cord attached to the framed work is received within the slot portions. Gravity pulls the cord down into the slot such that the cord frictionally engages surfaces on both the backing plate and the projections. The slot portions are separated, resulting in a relatively large contact area between the cord and the device.

In one embodiment, the dimensions of the backing plate are reduced from top to bottom between the two projections. The backing plate may thus be broken by the end user into two portions where its dimensions are reduced. The two portions of the device may thus be individually attached to the wall at separate, spaced locations. The device is then used to support a framed work in the basic manner described above, except that it is particularly suited for hanging large framed works.

Once the device has been separated into first and second portions, each of these portions may be used by itself to having a single framed work. In this case, the framed work will likely be relatively small.

The present invention thus operates in one of three modes. When only one framed work needs to be hung and this work is of medium to small size, the device is not separated into two portions but is rather attached to the wall in its original form. When a large framed work is to be hung, the device is used in a second mode in which it is separated into two portions and the two portions are attached at horizontally spaced locations on the wall. When two relatively small framed works need to be hung, the device operates in a third mode in which it is separated into two portions and each portion is used individually to hang one of the framed works.

Additionally, the design of the exemplary device described below is particularly suited to the injection molding process. The device also forms V-grooves which enhance the frictional engagement between the cord and the device surfaces to prevent movement of the cord relative to the device.

The present invention may thus be embodied in devices and methods that lend themselves to easy manufacture, are very flexible in use, and would securely hang a framed work on the wall or the like in a manner that maintains the framed work in a desired orientation over time.

DETAILED DESCRIPTION

Figure 6:
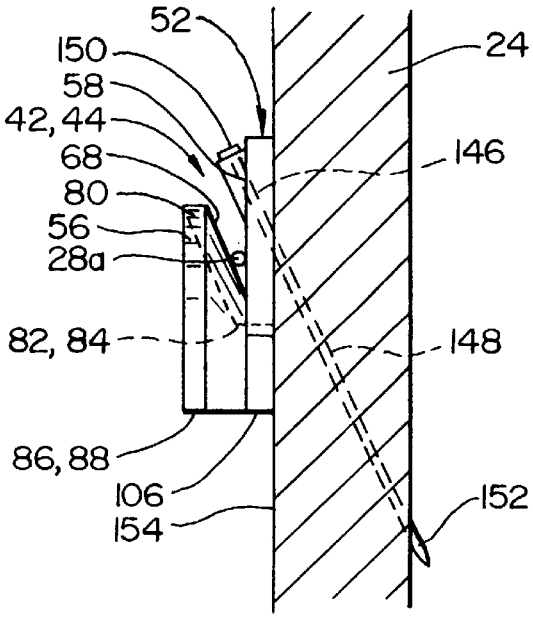
FIG. 6 is a side, elevational view showing the system for attaching the device of FIG. 1 to a wall and also the relationship of various surfaces on the device.

Referring now to the drawing, depicted at 20 therein is a wall hanging device constructed in accordance with, and embodying, the principles of the present invention. The device 20 is employed to hang a framed work 22 (FIGS. 2 and 3A–3C) on a wall 24 (FIG. 6).

Figure 1:
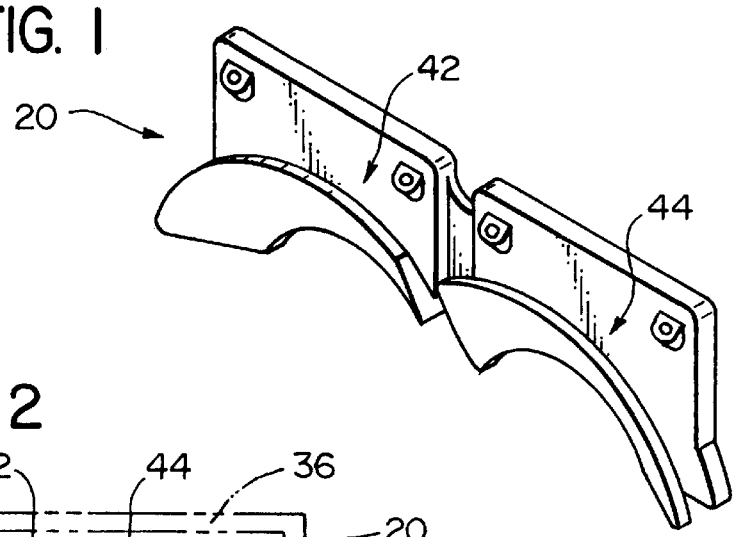
FIG. 1 is a perspective view of a devices constructed in accordance with, and embodying, the principles of the present invention.
Figure 2:
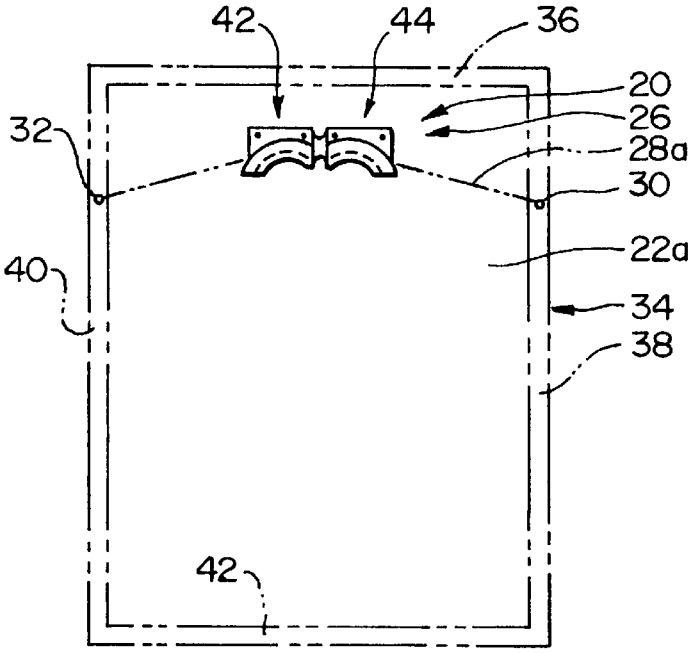
FIG. 2 is a front elevational view showing the device of FIG. 1 operating in a first mode.

Referring initially to FIG. 2, it can be seen that the device 20 is used as part of a system 26 including a cord 28 to hang the framed work 22*a*. The cord 28 is conventional and is affixed at points 30 and 32 to a frame assembly 34 of the framed work 22*a*. As is conventional, the frame assembly 34 comprises a top member 36, a right side member 38, a left side member 40, and a bottom member 42. The points 30 and 32 are located on the right and left side members 38 and 40, respectively.

Shown in FIG. 2 is a first mode of using the device 20 of the present invention. With the cord 28 connected to the frame assembly 34, the cord is received in first and second slot portions 42 and 44 defined by the device 20. The device 20 thus hooks and cradles the cord 28 in a manner that suspends the cord 28, and thus the framed work 22*a*, at a desired location and in a desired orientation on the wall 24.

Figure 3A:
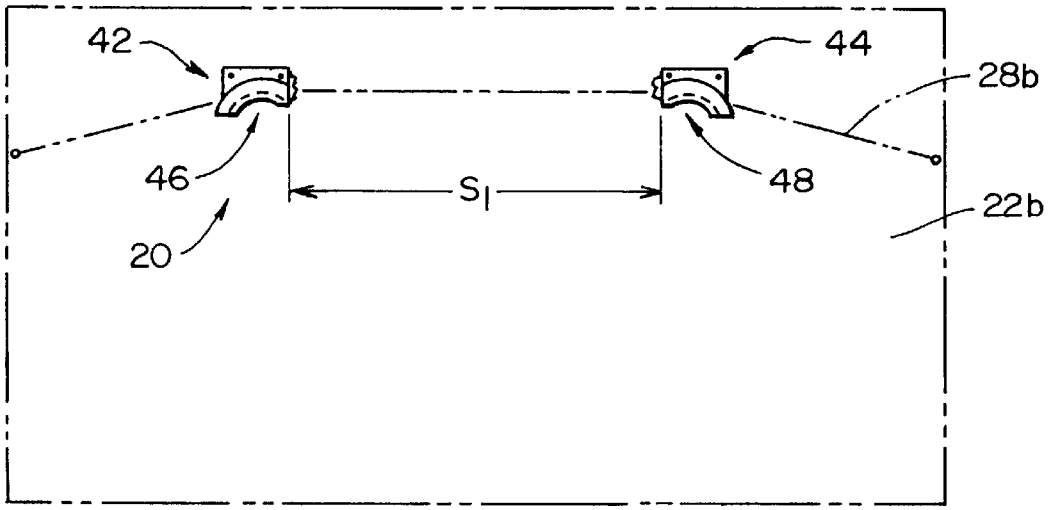
FIGS. 3A and 3B are front elevational views showing the device of FIG. 1 operating in a second mode.
Figure 3B:
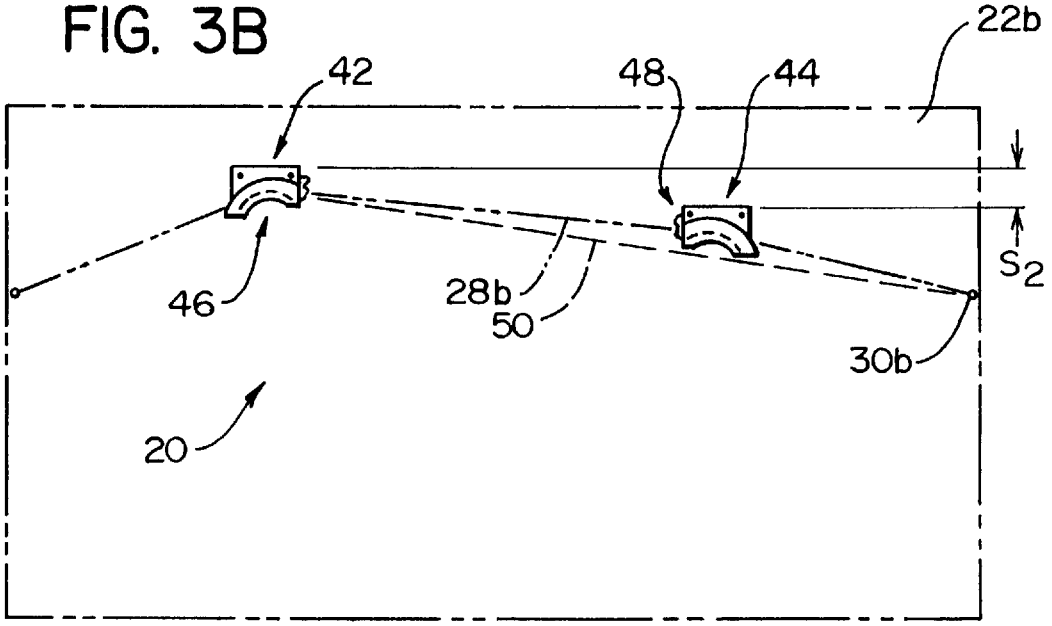

Referring now to FIGS. 3A and 3B, a second mode of using the device 20 is depicted therein. In particular, it can be seen that the device 20 has been broken into a first portion 46 and a second portion 48. Each of these portions 46 and 48 are affixed to the wall 24 using the same basic system shown in FIG. 6. However, as can be seen in FIG. 3A, the portions 46 and 48 are spaced from each other by a distance $S_1$. The first slot portion 42 is formed on the first device portion 46, while the second slot portion 44 is formed on the second device portion 48. The cord 22*b* attached to the framed work 22*b* is received within these slot portions 42 and 44 to suspend the framed work 22*b* at a desired location on the wall 24.

FIG. 3B depicts a situation almost identical to that shown in FIG. 3A. In FIG. 3B the same framed work 22*b* is hung on the wall 24 by the cord 28*b*, which is received in slots 42 and 44 defined by the device portions 46 and 48. The primary difference between the situations depicted in FIGS. 3A and 3B is that the second device portion 48 is lower than the first device portion 46 by a distance $S_2$. As long as this distance $S_2$ is not so large that the cord 28 becomes parallel with the line 50 extending between the first device portion 46 and the point 30*b* at which the cord 28*b* is connected to the framed work 22*b*, the framed work 22*b* can still be hung in its desired orientation on the wall 24. Accordingly, while there are some limits, the device portions 46 and 48 need not be perfectly aligned with each other in order to allow the framed work 22*b* to be hung in its desired orientation on the wall 24.

Figure 3C:
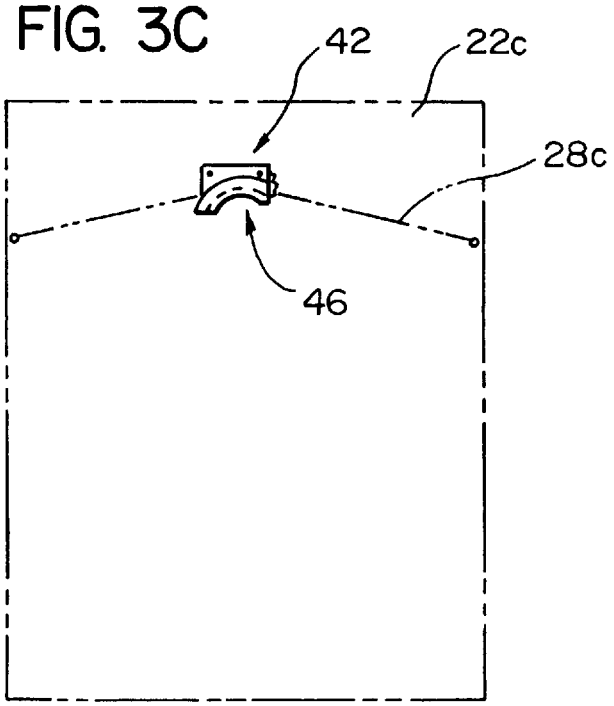
FIG. 3C is a front elevational view showing the device of FIG. 1 operating in a third mode.

Referring now to FIG. 3C, the device 20 is being used in yet a third mode of operation. In particular, a framed work 22*c* is suspended by a cord 28*c* which is received within the first slot portion 42 defined by the first device portion 46. The second device portion 48 is not shown in FIG. 3C, but may similarly be used by itself to suspend another framed work from a wall or the like. Thus, in the third mode, the device 20 is separated into its first and second portions 46 and 48, each of which is used independently to hang a framed work on a wall.

The device 20 will now be described in further detail with reference to FIGS. 4–8. In these Figures, the device 20 is shown in its first mode (i.e., it is not separated into its first and second portions).

Figure 4:
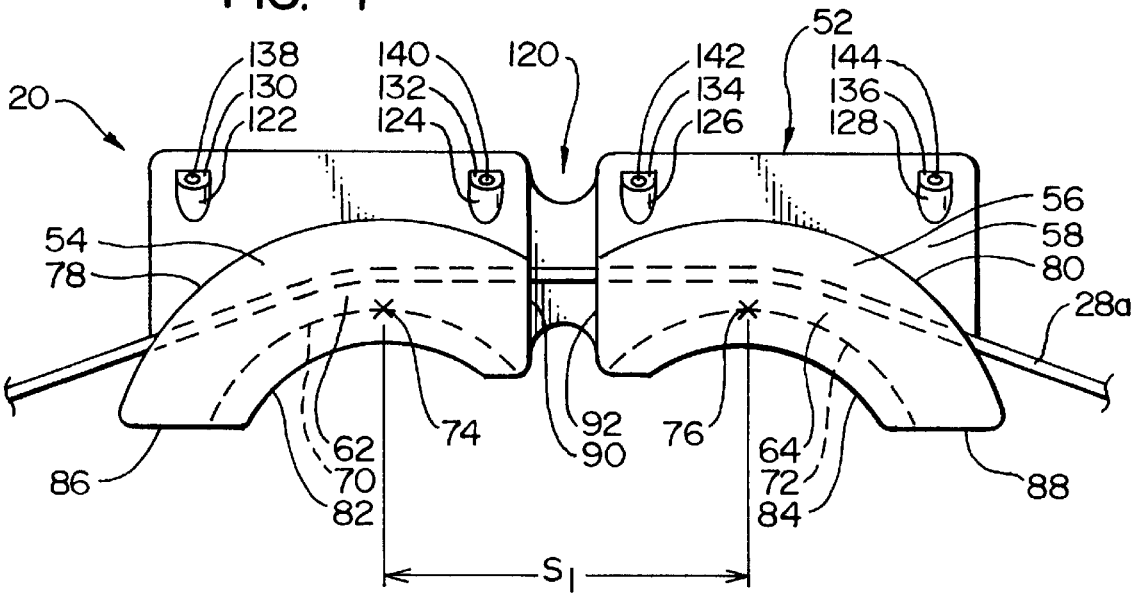
FIG. 4 is a front elevational view showing in greater detail how the device of FIG. 1 engages a cord attached to a framed work.
Figure 5:
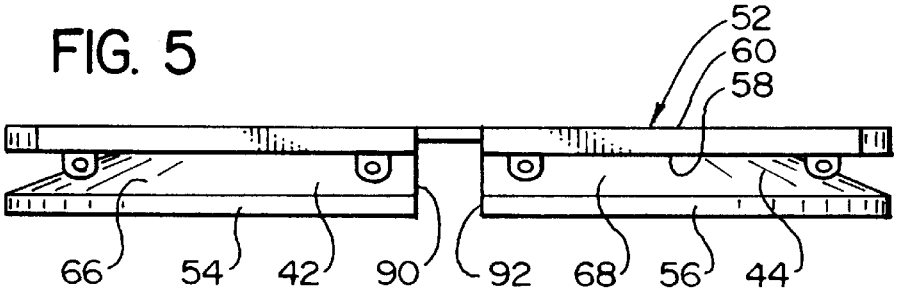
FIG. 5 is a top plan view of the device depicted in FIG. 1.

Referring initially to FIG. 4, depicted therein is a front elevational view of the device 20. This view also shows a section of the cord 28*a* discussed above.

The device 20 comprises a backing plate 52 and first and second projections 54 and 56. The backing plate has a front surface 58 and a rear surface 60. The projections 54 and 56 have front surfaces 62 and 64 and back surfaces 66 and 68, respectively. As perhaps best shown in FIGS. 5 and 6, the slot portions 42 and 44 described above are defined as the space or void between the backing plate front wall 58 and the projection rear walls 66 and 68.

The projection rear surfaces 66 and 68 are canted with respect to the backing plate front wall 58 such that the slot portions 42 and 44 have a generally V-shaped cross section. Thus, as the cord is received within the slot portions 42 and 44, it is pinched between the backing plate front wall 58 and the rear walls 66 and 68 of the projections 54 and 56. This pinching affect on the cord 28*a* increases the effect of friction between the cord 28*a* and the device 20 to inhibit relative movement between the device 20 and the cord 28*a*.

Referring now for a moment to FIG. 4, depicted therein by broken lines are a first juncture line 70 and a second juncture line 72. These juncture lines 70 and 72 are formed where the backing plate front wall 58 intersects the rear walls 66 and 68 of the projections 54 and 56. These juncture lines 70 and 72 are curved and have what would be referred to as points of inflection where indicated by reference characters 74 and 76. These points of inflection 74 and 76 correspond to the points where the juncture lines 72 and 74 are horizontal when the device 20 is in normal use. These points of inflection 74 and 76 are spaced from each other by a predetermined minimum distance $S_1$.

The projections 54 and 56 have upper edges 78 and 80 and lower edges 82 and 84. The projections 54 and 56 further define lower end edges 86 and 88 and inner end edges 90 and 92. In normal use, the lower end edges 86 and 88 are horizontal, and the inner end edges 90 and 92 are vertical.

The line segments 70 and 72 have a first radius of curvature $R_1$ and a length $L_1$, the upper edges 78 and 80 have a second radius of curvature $R_2$ and a length $L_2$, and the lower edges 82 and 84 have a third radius of curvature $R_3$ and a length $L_3$. The line segment 70, upper edge 78, and lower edge 82 form portions of circles centered at a first point, and the line segment 72, the upper edge 80 and lower edge 84 form portions of circles centered at a second point.

Figure 8:
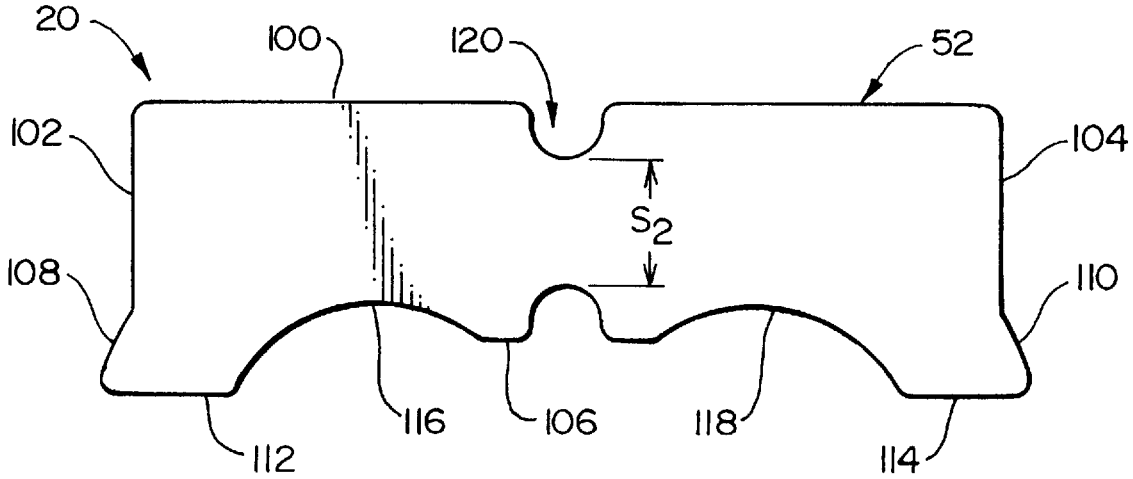
FIG. 8 is a rear elevational view of the device shown in FIG. 1.

Referring now to the backing plate 52, the overall configuration of the backing plate 52 is perhaps best shown in FIG. 8. The backing plate 52 comprises an upper edge 100, side edges 102 and 104, and a lower edge 106. The exact shape of the backing plate 52 is not critical; however, in the exemplary device 20 the side and lower edges 102–106 generally conform to the shape of the projections 54 and 56. In particular, the side edges 102 and 104 have outwardly canted portions 108 and 110 that conform to portions of the upper edges 78 and 80 of the projections 54 and 56. The lower edge 106 comprises first and second portions 112 and 114 that conform to the lower ends 86 and 88 of the projections 54 and 56. The lower edge 106 further comprises third and fourth portions 116 and 118 that correspond to the lower edges 82 and 84 of the projections 54 and 56.

Figure 7:
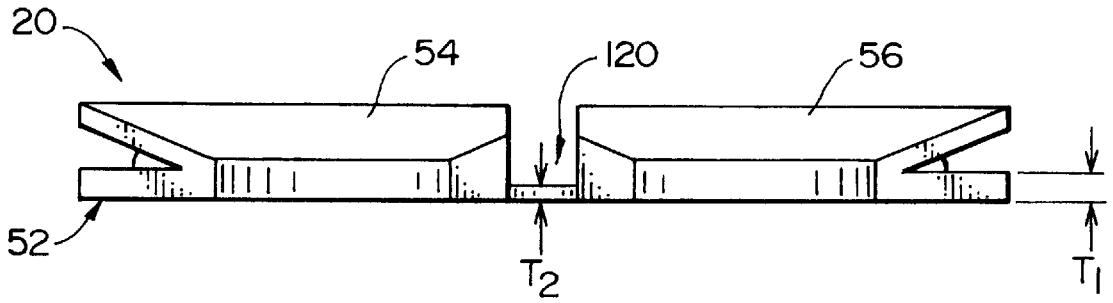
FIG. 7 is a bottom plan view of the device shown in FIG. 1.

An important aspect of the backing plate 52 can be seen in FIGS. 7 and 8. In particular, the backing plate 52 comprises a reduced dimension portion 120. This portion 120 is reduced in both thickness and top-to-bottom dimensions with respect to the rest of the backing plate 52. While most of the backing plate 52 has a thickness $T_1$, the reduced dimension portion 120 has a thickness $T_2$ less than the thickness $T_1$. And as shown in FIG. 8, the reduced dimensions portion 120 has a minimum bottom-to-top dimension $S_2$ that is shorter in this direction than any other point on the backing plate 52.

The reduced dimension portion 120 allows the device 20 to be separated into the first and second portions 46 and 48 described above. More specifically, the device 20 may be broken into the two portions 46 and 48 simply by grasping the device 20 and bending it at the reduced dimensions portion 120 until it breaks.

Referring now back to FIG. 4, it can be seen that the backing plate further comprises first, second, third, and fourth buttresses 122, 124, 126, and 128. These buttresses 122–128 define upper surfaces 130, 132, 134, and 136. Bores 138–146 extend through the backing plate 52 at these buttresses 122–128 from the front surface 58 of the backing plate to the back surface 60 thereof, as perhaps is best shown in FIG. 6.

Nails such as the nail 148 are inserted into the bores 138–146 and hammered into the wall 24 to secure the device 20 onto the wall 24. The buttresses 122–128 effectively increase the thickness of the backing plate 58 where necessary to support the loads transmitted to the nails 148 through the device 20. Heads 150 of the nails 148 engage the upper surfaces 130–136, while tips 152 of the nails extend into and perhaps through the wall 124.

An angle $\alpha$ at which the bores 138–146 extend through the backing plate 58 are, in the exemplary device 20, the same as the angle $\beta$ at which the rear wall 68 extends relative to the front surface 58 of the backing plate 52. While not critical for the operation of the device during use, this arrangement of angles greatly facilitates the fabrication of the device 20 using an injection molding process. More specifically, the holes 138–146 may be integrally formed in the device 20 during the molding process.

While the exact angles are somewhat arbitrary, the angle $\beta$ should not be so great that the cable 28*a* is not pinched within the slot portions 42 and 44, and the angle $\alpha$ should be large enough that the nail adequately penetrates and is held by the wall 24.

Figure 9:
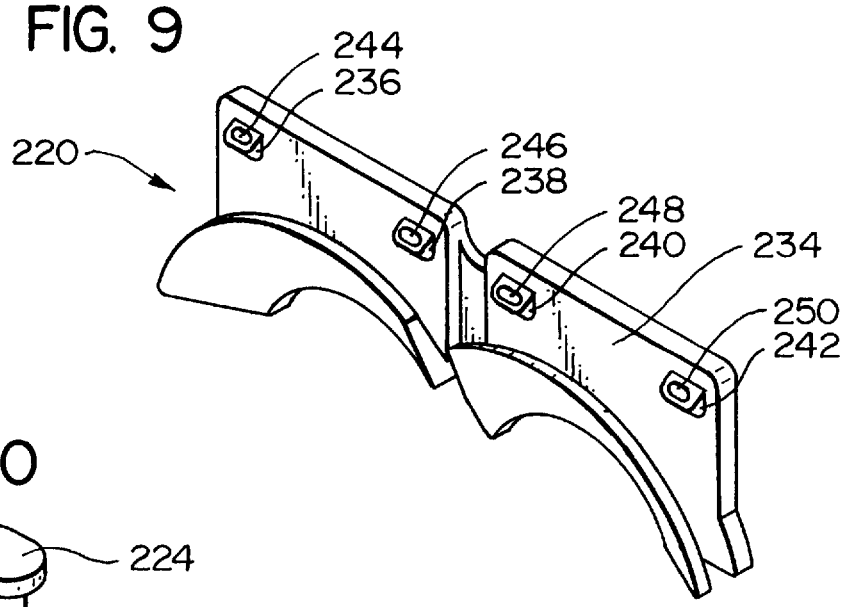
FIG. 9 is a perspective view of yet another exemplary wall hanging device constructed in accordance with, and embodying, the principles of the present invention.

Referring now to FIG. 9, depicted at 220 therein is yet another embodiment of a picture hanging device constructed in accordance with the present invention. This device 220 is similar to the device 20 discussed above and will be described herein only to the extent that it differs therefrom.

Figure 10:
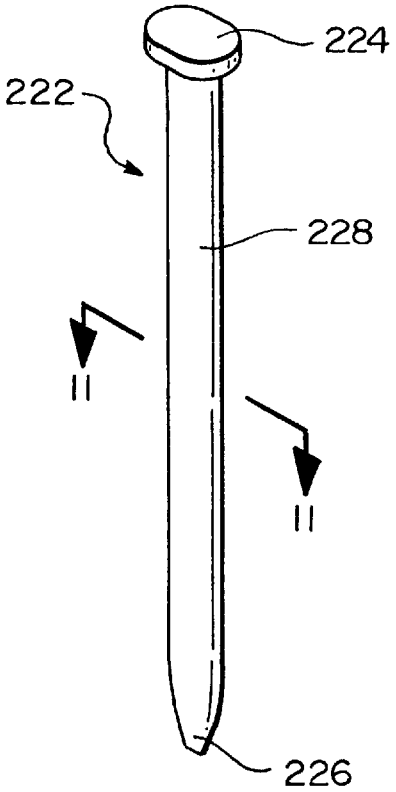
FIG. 10 is a perspective view of a tack to be used in a wall hanging system along with the device depicted in FIG. 9.
Figure 11:
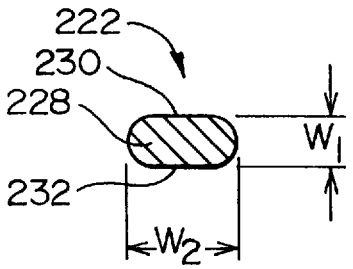
FIG. 11 is a section view taken along lines 11—11 in FIG. 10.

The device 220 is used as part of a system also comprising a plurality of tacks 222 (FIGS. 10 and 11). These tacks 222 are similar in purpose to the nails 148 described above and in that they comprise a head 224 and tip 226. But the tacks 222 have shaft portions 228 that, as shown in FIG. 11, have a cross-section that is elongated. These shafts have a first dimension $W_1$ and second dimension $W_2$ that is approximately twice the first dimension $W_1$; this configuration creates relatively wide surfaces 230 and 232 that, when the tacks 222 penetrate a wall, are less likely to tear out the wall.

Projecting from a front surface 234 of the device 220 are buttresses 236, 238, 240, and 242 in which are formed slots 244, 246, 248, and 250, respectively. The buttresses 226–232 and slots 234–240 are similar to the buttresses 122–128 and holes 138–146 described above but are slightly elongated to accommodate the larger dimension $W_2$ of the tack shaft 228. The tacks 222 thus penetrate the holes 244–250 in a manner that forces the loads transmitted through the tack shafts 228 to be through one of the relatively wide surfaces 230 or 232. The system comprising the device 220 and tacks 222 thus more securely attaches a framed work to a wall.

The following Table A sets forth exemplary dimensions for the parameters introduced above:

| Dimension | Exemplary Embodiment | First Preferred Range | Second Preferred Range |
|---|---|---|---|
| $S_1$ | 1.40" | 0.25–4.00" | >0.25" |
| $S_2$ | 0.45" | 0.10–1.00" | 0.05–1.50" |
| $R_1$ | 0.9327" | 0.50–1.50" | >0.30 |
| $R_2$ | 0.812" | 0.50–1.50" | >0.30 |

-continued

| Dimension | Exemplary Embodiment | First Preferred Range | Second Preferred Range |
|---|---|---|---|
| $R_3$ | 0.625" | 0.50–1.50" | >0.30 |
| $L_1$ | 1.500" | 0.50–2.5" | >0.30 |
| $L_2$ | 1.900" | 0.50–3.5" | >0.30 |
| $L_3$ | 1.200" | 0.50–3.5" | >0.30 |
| $\alpha$ | 25° | 15–35° | 10–75° |
| $\beta$ | 25° | 15–35° | 10–75° |
| $T_1$ | 0.85" | 0.065–0.105" | 0.050–0.200" |
| $T_2$ | 0.0425" | 0.035–0.050" | 0.025–0.065" |
| $W_1$ | 0.0425" | 0.40–0.45" | 0.35–0.60" |
| $W_2$ | 0.085" | 0.082–0.088" | 0.075–0.100" |

It is to be recognized that various modifications can be made without departing from the basic teaching of the present invention.

What is claimed is:

1. A device for hanging one or two framed works on at least one vertical surface, where each framed work comprises a cord, the device comprising:

a backing plate having front and rear surfaces; and slot structure extending from the front surface of the backing plate and having first and second structure portions having first and second rear surface portions, respectively; wherein a first slot portion is defined between the first rear surface portion of the slot structure and the front surface of the backing plate;

a second slot portion is defined between the second rear surface portion of the slot structure and the front surface of the backing plate;

a first juncture line is formed where the first rear surface portion of the slot structure engages the front surface of the backing plate, the first juncture line having a first point of inflection;

a second juncture line is formed where the second rear surface portion of the slot structure engages the front surface of the backing plate, the second juncture line having a second point of inflection;

the first and second juncture lines are curved such that they contain portions that extend downwardly from either side of the first and second points of inflection;

the backing plate has a reduced dimension portion between the first and second structure portions to allow the device to be separated by the end user into first and second device portions, where the first slot portion is defined by the first device portion and the second slot portion is defined by the second device portion: and the device may be used in a first mode to suspend a single framed work in which the device is not separated into the first and second device portions, where the device is attached to a vertical surface and the cord of the framed work engages the first and second slot portions defined by the device, a second mode to suspend a single framed work in which the backing plate is separated into the first and second device portions, where the first and second device portions are attached to a vertical surface at horizontally spaced locations and the cord of the framed work engages the first and second slot portions defined by the first and second device portions, and a third mode to suspend two framed works in which the backing plate is separated into the first and second device portions, where the first and second device portions are attached to one or more vertical surfaces at spaced locations and the cord of one of the framed works engages the first slot portion defined by the first device portion and the cord of the other of the framed works engages the second slot portion defined by the second device portion.

2. A device as recited in claim 1, in which the points of inflection are spaced from each other by a predetermined minimum distance.

3. A device as recited in claim 2, in which the predetermined minimum distance is at least one half of one inch.

4. A device as recited in claim 3, in which the predetermined minimum distance is between one half of one inch and four inches.

5. A device as recited in claim 4, in which the predetermined minimum distance is approximately one and three-eighths inch.

6. A device as recited in claim 1, further comprising at least one nail hole formed in the backing plate, in which the nail hole is substantially parallel to at least a portion of the first and second rear surface portions of the slot structure to facilitate injection molding of the device.

7. A device as recited in claim 1, further comprising at least one nail hole formed in the backing plate, in which the nail hole extends at a first angle relative to the front surface of the backing plate and the first and second rear surface portions extend at a second angle relative to the front surface of the backing plate, where the first and second angles are substantially the same.

8. A method of hanging objects on a vertical surface, comprising the steps of:

attaching a cord to first and second attachment points on one of the objects;

providing an attachment member having a backing plate having a reduced thickness portion and first and second projections defining first and second slot portions, where the slot portions define first and second points of inflection, the slot portions are curved downwardly on either side of the first and second points of inflection, the points of inflection are separated from each other by a predetermined distance, and the reduced thickness portion is arranged between the first and second projections to allow the attachment member to be separated into first and second attachment member portions;

affixing the attachment member to the vertical surface;

displacing the one of the objects such that the cord is received within at least one of the first and second slot portions; arranging the one of the objects such that it is in a desired orientation; and downwardly displacing the one of the objects while maintaining it in the desired orientation until the cord frictionally engages the backing plate and at least one of the first and second projections in a manner that inhibits movement of the cord relative to at least one of the first and second projections.

9. A method as recited in claim 8, in which the step of displacing the one of the objects comprises the step of displacing the one of the objects such that the cord is received within both of the first and second slot portions and the cord frictionally engages both of the first and second projections.

10. A method as recited in claim 8, in which the step of affixing the attachment member to the vertical surface comprises the step of affixing the first and second attachment member portions to the vertical surface such that the attachment member portions are spaced from each other.

11. A method as recited in claim 10, further comprising the steps of:

attaching a cord to first and second attachment points on an other of the objects;

displacing the other of the objects such that the cord is received within at least one of the first and second slot portions;

arranging the other of the objects such that it is in another desired orientation; and downwardly displacing the other of the objects while maintaining it in the other desired orientation until the cord frictionally engages the backing plate and at least one of the first and second projections in a manner that inhibits movement of the cord relative to at least one of the first and second projections.

12. A method as recited in claim 11, in which the cord attached to the one of the objects is received within the first slot portion and the cord attached to the other of the objects is received within the second slot portion.

13. A device for hanging framed works on walls, comprising:

a backing plate having front and rear surfaces and defining first, second, third, and fourth nail holes;

a nail that extends through at least two of the nail holes into the wall to attach the backing plate onto the wall;

first and second slot projections that extend from the front surface of the backing plate, that are spaced from each other, and that have first and second rear surface portions formed thereon, respectively; wherein a first slot portion is defined between the first rear surface portion of the slot structure and the front surface of the backing plate, the first slot portion having a first point of inflection and being curved in two directions downwardly away from the first point of inflection;

a second slot portion is defined between the second rear surface portion of the slot structure and the front surface of the backing plate, the second slot portion having a second point of inflection and being curved in two directions downwardly away from the second point of inflection;

a reduced dimension portion is formed on the backing plate between the first and second slot portions to allow the device to be separated by the end user into first and second device portions, where the first device portion defines the first slot portion and the second device portion defines the second slot portion; and the device is used in one of the following three modes a first mode in which the device is not separated into first and second device portions and a cord attached to a framed work is received in the first and second slot portions;

a second mode in which the device is separated into first and second device portions and a cord attached to a framed work is received in the first and second slot portions; and a third mode in which the device is separated into first and second device portions, a first cord attached to a first framed work is received in the first slot portions, and a second cord attached to a second framed work is received in the second slot portions.

* * * * *